United States Patent [19]

Goodman et al.

[11] Patent Number: 4,544,224

[45] Date of Patent: Oct. 1, 1985

[54] SELF-LOCKING ELECTRICAL CONNECTOR

[75] Inventors: David S. Goodman, Mission Viejo; Gerald J. Selvin, Huntington Beach; Hubert W. Naus, Monrovia; David Rofer, Fountain Valley; Randy A. McNutt, Fullerton, all of Calif.

[73] Assignee: International Telephone & Telegraph Corp., New York, N.Y.

[21] Appl. No.: 415,362

[22] Filed: Sep. 7, 1982

[51] Int. Cl.[4] ..... H01R 13/639

[52] U.S. Cl. ..... 339/89 M; 339/DIG. 2

[58] Field of Search ..... 339/89 R, 89 M, 89 C, 339/113 R, 90 R, 90 C, 90 F, DIG. 2; 285/81, 82, 92

[56] References Cited

U.S. PATENT DOCUMENTS

| | | | |
|---|---|---|---|
| 3,669,472 | 6/1972 | Nadsady | 285/87 |
| 3,907,395 | 9/1975 | Flanagan | 339/99 R |
| 4,202,589 | 5/1980 | Reavis, Jr. et al. | 339/97 R |
| 4,268,103 | 5/1981 | Schildkraut | 339/113 R |
| 4,277,125 | 7/1981 | Ball | 339/89 M |
| 4,290,092 | 9/1981 | Bull | 339/90 F |
| 4,290,662 | 9/1981 | Storcel | 339/89 M |
| 4,322,121 | 3/1982 | Riches et al. | 339/89 M |
| 4,407,529 | 10/1983 | Holman | 339/89 R |

FOREIGN PATENT DOCUMENTS

| | | | |
|---|---|---|---|
| 0059310 | 4/1947 | Netherlands | 339/91 R |

*Primary Examiner*—Gil Weidenfeld
*Assistant Examiner*—Thomas M. Kline
*Attorney, Agent, or Firm*—T. L. Peterson; R. C. Turner

[57] ABSTRACT

A self-locking electrical connector is disclosed in which a locking ring is mounted in an annular groove in the interior of a coupling nut on the plug of the connector. When the plug is mated with the receptacle, inwardly extending projections on the locking ring ride up over a low-angle ramp on the shell of the receptacle and then snap into a locking groove formed in the receptacle shell behind the ramp to lock the connector members together. The surface of the locking groove next to the low-angle ramp is formed as a high-angle ramp which allows removal of the projections of the ring from the groove when the coupling nut is rotated with high torque to unthread from the shell. In an alternative embodiment, the locking ring is carried by the receptacle shell, and the locking groove and angular ramps are formed on the inner surface of the coupling nut.

20 Claims, 5 Drawing Figures

SELF-LOCKING ELECTRICAL CONNECTOR

BACKGROUND OF THE INVENTION

The present invention relates generally to an electrical connector and, more particularly, to a self-locking electrical connector.

Some electrical connectors embody self-locking mechanisms contained in or attached to the connector shell to provide an interlock between the connector halves and to maintain the connector in its mated condition. One such self-locking connector is disclosed in U.S. Pat. No. 3,552,777 to Heinrich. The locking mechanism disclosed in the Heinrich patent is sometimes referred to as being of the "click-stop" type. The interconnection between the mating connector members includes a set of balls uniformly spaced about the periphery which cooperates with recesses or holes in a locking or clicker plate to provide a click-stop effect as the coupling nut is tightened. It is also known to form the holes so as to have a pear-shaped configuration to reduce wear on the locking plate and facilitate rotation of the plate and hence the coupling nut in the clockwise, locking direction. As a result, the anti-vibration locking feature of the click-stop arrangement of the connector is delayed toward final engagement between the mating connector members. However, it is preferred that the locking feature not take effect until final engagement between the connector members. Further, the click-stop arrangement does not provide as positive a lock between the mating connector halves as is desired for some applications in which the connector is subjected to very high shock or vibration. Moreover, the locking mechanism requires a number of additional components, adding to the cost of the connector.

Some electrical connectors provide a more positive self-locking between the connector members. Such a connector is disclosed in U.S. Pat. No. 3,843,853 to Panek et al., assigned to the assignee of the present application. This patent discloses a self-locking mechanism which has been referred to as a "ring lock." In this connector, matching grooves are formed in the outer surface of the plug barrel and the inner surface of the receptacle shell. The grooves are aligned when the plug and receptacle are fully mated. The groove in the plug barrel is deeper than the groove in the receptacle shell. A split ring is mounted in the grooves. In its normal unstressed condition the ring is lodged in both the grooves thereby interlocking the mating plug and receptacle halves of the connector. The locking ring is retained in its locking position by a radially extending pin disposed between the free ends of the split ring. When the pin is removed the split ring is free to be contracted upon application of an axially directed unmating force to the mating connector members.

While the Panek et al. connector locking mechanism is entirely adequate for many applications, the locking arrangement embodies several features which will impose limitations on the use of the connector for certain applications. For example, the locking ring must be mounted on an external diameter and must be allowed to contract radially inwardly. Further, the location of the gap in the split ring must be properly oriented to assure proper engagement of the lock pin therein. Although the ring gap location problem can be solved in a variety of ways, the problem of weight addition to the ring-carrying connector half, and the necessity to carry the ring on an external diameter pose more difficult problems. Furthermore, the ring lock arrangement does not provide a threaded coupling mechanism as is required for some applications to provide a high coupling force to allow interengagement of a large number of mating contacts in the two connector members.

It is the object of the present invention to provide an improved, simple, low cost, self-locking mechanism for an electrical connector which does not engage until the last coupling turn of the coupling nut to the shell thus requiring only a low-engagement force, and provides an effective interlock between the mating connector members which resists loosening of the coupling arrangement even when the connector is subjected to high shock, vibration or temperature working.

SUMMARY OF THE INVENTION

According to a principal aspect of the present invention, there is provided a self-locking electrical connector in which annular grooves are formed in the outer surface of the receptacle shell and the inner surface of the plug coupling ring. The grooves become axially aligned when the plug and receptacle are fully mated. The front surface of the groove in one of the cylindrical surfaces, i.e., the locking groove, forms a high-angle rearwardly facing ramp. A low-angle forwardly facing ramp is formed on said surface in front of the locking groove. A radially deformable locking ring lies in both of the grooves when the connector members are fully mated. Upon rotation of the coupling ring in one direction to mate the connector members the locking ring rides up over the low-angle ramp and snaps into the locking groove behind the ramp to releasably lock the coupling ring to the receptacle shell. Upon rotation of the coupling ring with high torque force in the opposite direction the locking ring rides over the high-angle ramp to become released from the locking groove and to thereby allow unmating of the connector members.

By this arrangement, the locking mechanism does not engage until the last turn of the coupling ring to the shell. Thus, only a low engagement force is required to couple the connector members together. When the locking ring snaps into the locking groove upon full mating of the connector members, a tactile indication is provided of the locking and, hence, full mating of the connector. The locking mechanism of the present invention holds the coupling ring in place during use and prevents it from loosening due to shock, vibration or temperature working. Furthermore, by the present invention the locking ring may be mounted in an internal diameter, if desired, rather than on an external diameter as in the Panek et al. connector.

DESCRIPTION OF THE PREFERRED EMBODIMENTS

Figure 1:
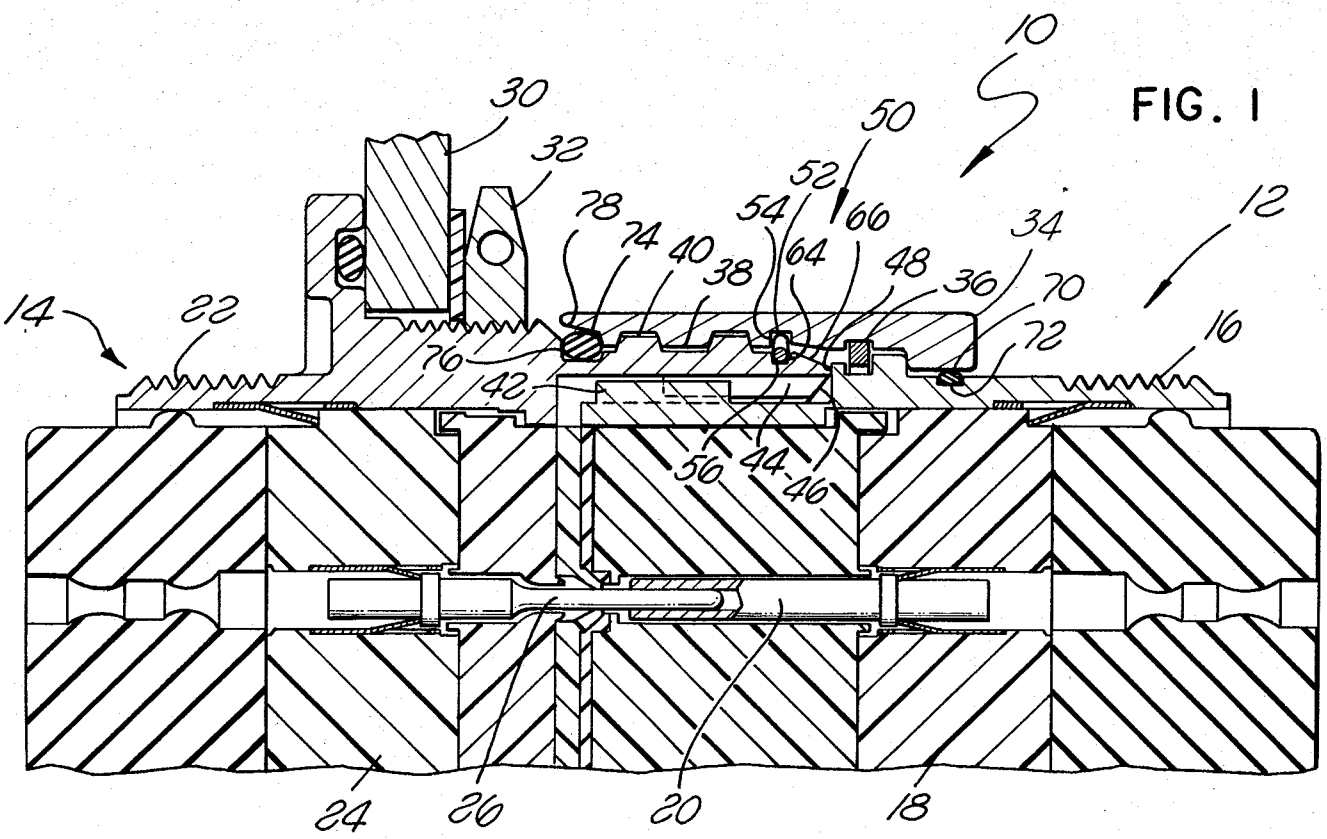
FIG. 1 is a fragmentary, partial longitudinal sectional view of a fully mated electrical connector embodying one form of the self-locking mechanism of the present invention.
Figure 2:
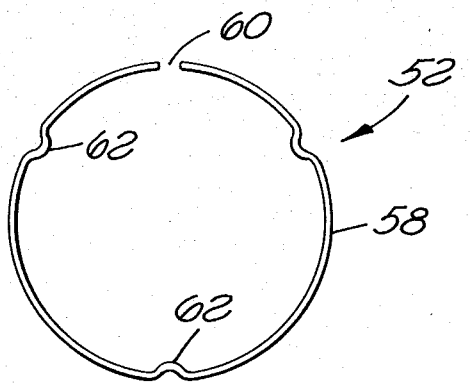
FIG. 2 is an elevational view of the locking ring utilized in the connector illustrated in FIG. 1.

Referring now to the drawings in detail, wherein like reference numerals are utilized to designate the same or corresponding parts throughout the various views, there is illustrated in FIGS. 1 and 2 one embodiment of the self-locking connector of the present invention, generally designated 10. The connector 10 comprises a plug 12 and a mating receptacle 14 which are shown in their fully mated condition. The plug comprises a barrel 16 surrounding an insulator insert assembly 18 containing a plurality of socket contacts 20, only one being shown. The receptacle 14 comprises a shell 22 surrounding an insulator insert assembly 24 containing a plurality of pin contacts 26 each adapted to mate with a corresponding socket contact 20 when the plug and receptacle are interengaged. The receptacle is shown as being mounted on a mounting plate 30 by a jam nut 32.

A coupling ring 34 is rotatably mounted on the plug barrel 16, and is held against axial movement on the barrel by a retaining ring 36. The coupling ring is preferably in the form of a conventional coupling nut having screw threads 38 on its internal surface adapted to engage with matching screw threads 40 on the exterior surface of the forward end of the shell 22. Preferably polarizing keys 42, only one being shown, are formed on the exterior surface of the forward end of the barrel 16. The keys are adapted to slide in matching longitudinally extending keyways 44 formed in the interior surface of the forward end of the shell 22. Preferably the shell 22 is dimensioned axially so that the forward end 46 thereof will bottom out against a forwardly facing shoulder 48 on the barrel 16 when the connector members 12 and 14 are fully mated to provide RFI protection. Alternatively, a slight taper fit could be provided between the forward end of shell 22 and barrel 16 to provide RFI shielding.

According to the present invention there is provided a self-locking coupling mechanism, generally designated 50, which will provide a firm interlock between the plug and receptacle when they are fully intermated by the coupling nut 34, yet does not become effective to lock the members together until the last turn of the coupling nut. The locking mechanism includes a locking ring 52 which can be best seen in FIG. 2. In the embodiment illustrated in FIGS. 1 and 2, the locking ring 52 is carried by the coupling nut 34. An annular groove 54 is formed in the interior surface of the coupling nut behind the screw threads 38 thereon. An annular locking groove 56 is formed in the exterior surface of the shell 22 in front of the screw threads 40 thereon. When the connector members are fully mated, the grooves 54 and 56 are axially aligned, as seen in FIG. 1.

Referring again to FIG. 2, the locking ring comprises a resilient split ring 58 providing a gap 60 between the two free ends of the ring. Radially inwardly extending resilient projections 62 are formed on the ring, preferably by inwardly bent portions of the ring. The depth of the groove 54 is selected such that when the locking ring 52 is mounted in the groove, the projections 62 will extend radially inwardly from the interior surface of the coupling nut into the locking groove 56 on the receptacle shell. While the ring 58 is shown as being a split wire form, it could be a continuous cylindrical ring, if desired, formed with resilient projections.

The front surface 64 of the locking groove 56 is formed as a high-angle rearwardly facing ramp. A longer, low-angle forwardly facing ramp 66 is formed on the exterior surface of the shell 22 in front of the groove 56.

During initial mating of the plug with the receptacle, the coupling nut 34 is rotated in the clockwise direction, as viewed from the rear of the plug, causing the threads 38 and 40 to interengage thereby pulling the plug barrel 16 forwardly so that the contacts 20 and 26 will mate. During initial rotation of the coupling nut, the locking ring 52 is remote from the threads on the receptacle shell so that it does not impose any restriction to mating of the connector members. During the last turn of the coupling nut the projections 62 on the locking ring will ride up over the relatively long low-angle ramp 66 on the forward end of the shell 22 under a low force. During this period, the bent in projections 62 will deform radially outwardly causing the gap 60 between the free ends of the spring 52 to shorten slightly. After the locking ring passes over the top of the ramp 66, it will slide quickly down into the groove 56 in a snapping action providing a tactile indication of complete locking and hence mating of the connector assembly.

Because of the high-angle ramp 64 located in front of the locking ring 52 a high torque force is required to run the ring up and out of the locking groove 56. Thus, in order to unlock and uncouple the connector 10, the coupling nut 34 must be rotated in a counter-clockwise direction with a high torque to force the projections 62 of the locking ring 52 out of the groove 56. During the uncoupling procedure, the resilient projections 62 will deform outwardly into the groove 54 in the coupling nut thereby allowing the locking ring to move rearwardly behind the peak formed between the ramps 64 and 66 so that the coupling nut may release from the receptacle shell 52. By altering the angle of the ramp 64 during the manufacture of the connector, the unlocking force can be changed to suit individual preferences. Also, the spring force of the locking ring 52 may be altered to achieve the same purpose if modification of the angle of the ramp 64 is not convenient, or does not provide enough angle to meet a particular requirement. Also, the inclination of the low-angle ramp 66 may be modified during manufacture to adjust the coupling force required to intermate the plug and receptacle of the connector 10.

Preferably an elastomeric O-ring 70 is mounted in a groove 72 in the barrel 16 adjacent to the rear of the coupling nut. The O-ring 70 provides a dynamic seal in that the coupling nut slides over the ring during mating of the plug and receptacle. If desired, the seal 70 could be mounted in a groove in the coupling nut rather than in the barrel 16. A second elastomeric O-ring 74 is mounted in an annular groove 76 formed in the shell 22 behind the threads 40. The O-ring 76 is engaged by an inwardly facing inclined surface 78 at the forward end of the coupling nut 34. When the coupling nut is rotated fully to its mating position the surface 78 slides over the O-ring 76 urging it radially inwardly to make a compression seal between the nut and the shell 22. Thus, the O-rings 70 and 76 provide seals at both ends of the coupling nut, and on opposite sides of the locking ring 52, thereby providing complete environmental protection to the internal parts of the connector at the interface of the plug and the receptacle.

Figure 3:
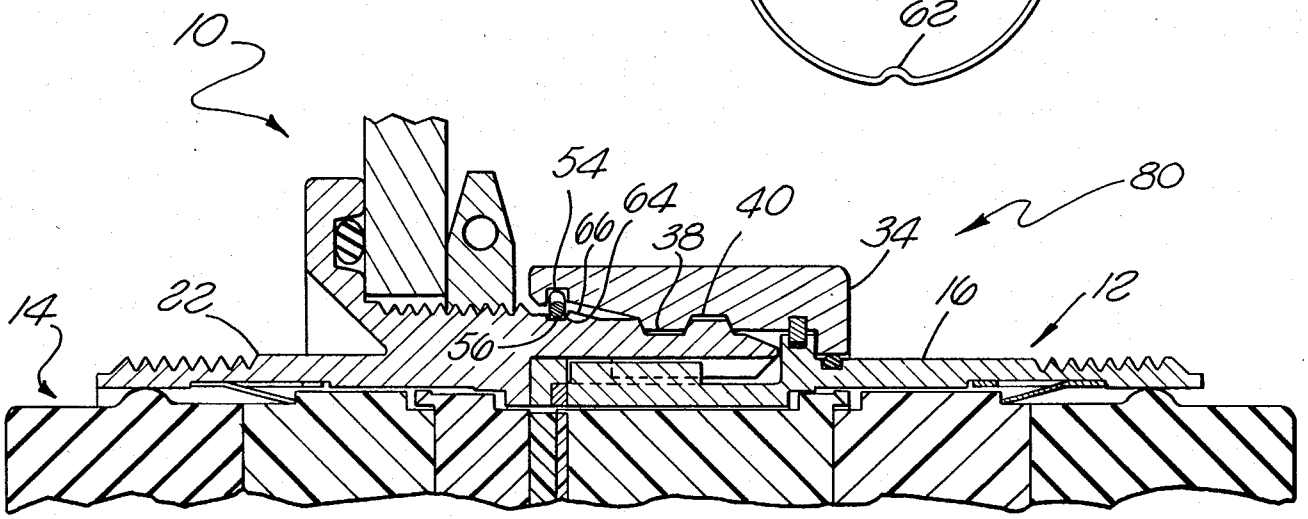
FIG. 3 is a fragmentary longitudinal sectional view of a connector similar to that illustrated in FIG. 1 but showing an alternative form of the coupling mechanism of the present invention, which utilizes a lock ring the same as that illustrated in FIG. 2.

Reference is now made to FIG. 3 of the drawings wherein there is illustrated a connector 80 embodying an alternative form of the locking mechanism of the present invention. In this embodiment, the groove 54 is formed in the forward end of the coupling nut 34 in front of the threads 38 thereon, and the locking groove 56 is mounted on the shell 22 behind the threads 40 and aligned with the groove 54 when the plug 12 is fully mated with the receptacle 14. As in the first embodiment of the invention, the locking ring 52 is carried by the coupling nut 34, and may be of the configuration illustrated in FIG. 2. The low-angle ramp 66 is formed on the exterior surface of the shell 22 in front of the groove 56 while the high-angle ramp 64 is formed by the inclined front surface of the groove 56 similar to the arrangement illustrated in FIG. 1. Because the locking ring is mounted in the front of the coupling nut, its inner diameter must be larger than the outer diameter of the threads 40 on the shell 22 so that the locking ring may pass over the threads when the coupling nut 34 is being threaded onto the shell 22. The term "inner diameter" is intended to mean the diameter of a circle passing through the innermost regions of the projections 62 on the ring. The locking mechanism illustrated in FIG. 3 will operate in the same manner as the locking mechanism 50 illustrated in FIGS. 1 and 2.

Figure 4:
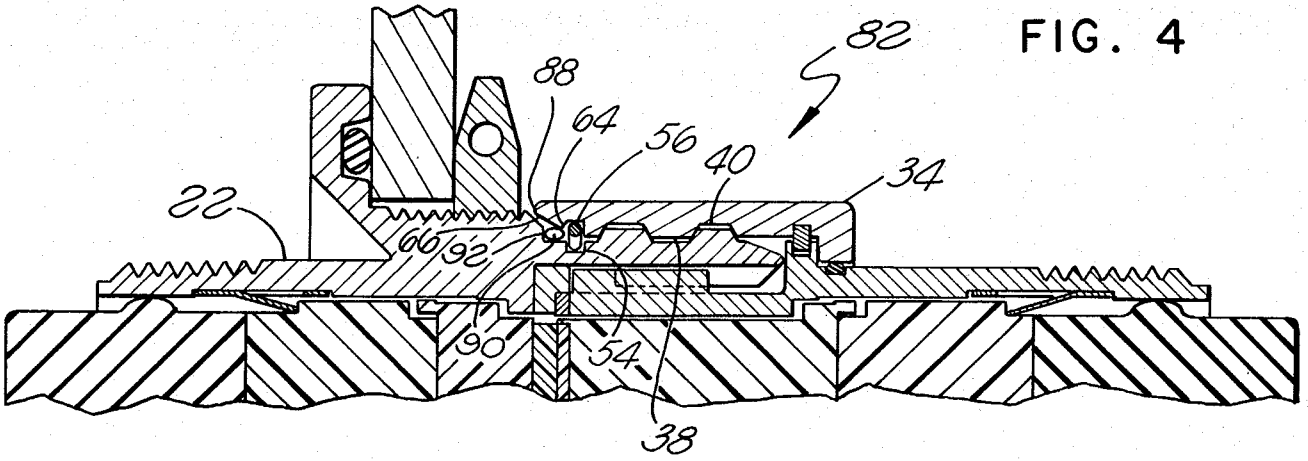
FIG. 4 is a fragmentary longitudinal sectional view of a connector embodying a third alternative form of the locking mechanism of the present invention.
Figure 5:
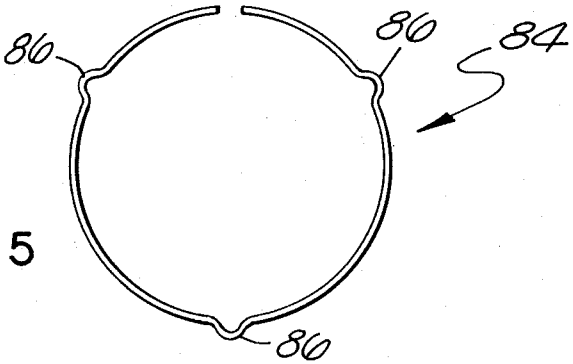
FIG. 5 is an elevational view of the locking ring utilized in the connector illustrated in FIG. 4.

Referring now to FIG. 4 of the drawings there is shown a connector 82 incorporating a third alternative form of the locking mechanism of the present invention. In this embodiment, the locking ring 84 is carried by the shell 22 rather than the coupling nut 34. As seen in FIG. 5, the projections 86 of the locking ring extend outwardly rather than inwardly. The locking ring is mounted in an annular groove 54 formed on the exterior surface of the shell 22 behind the screw threads 40. The projections 86 of the locking ring extend into an annular locking groove 56 formed in the interior of the coupling nut in front of the threads 38 thereon. The high-angle ramp 64 is formed by the front surface of the groove 56 while the low-angle ramp 66 extends forwardly from the groove toward the front edge 88 of the coupling nut. An O-ring 90 is positioned against a forwardly facing shoulder 92 on the shell 22 behind the groove 54, and is pressed against the shell by the low-angle ramp 66 on the coupling nut when the coupling nut is fully threaded on the shell. It will be appreciated that the internal diameter of the peak formed between the ramps 64 and 66 on the shell must be greater than the major internal diameter of the threads on the interior of the nut. The locking mechanism illustrated in FIG. 4 will operate in a fashion similar to the locking mechanisms illustrated in FIGS. 1 to 3 except that the projections 86 on the locking ring will initially deflect inwardly when the low-angle ramp 66 on the coupling nut passes over the ring, and the projections will expand outwardly into the locking groove 56 after the peak formed between the ramps moves forwardly beyond the locking ring to the position illustrated in FIG. 4.

Regardless of the location of the locking ring in the various embodiments of the invention disclosed herein, the ring serves to hold the coupling nut in place and prevents it from loosening due to shock, vibration or temperature working. The locking mechanism of the invention does not engage until the last turn of the coupling nut to the shell so that only a low engagement force is required to couple the plug and receptacle together. The locking mechanism is relatively simple and inexpensive to manufacture as compared to many of the prior art self-locking mechanisms utilized in electrical connectors.

What we claim:

1. An electrical connector comprising:

first and second mating connector members;

each said connector member comprising a shell surrounding an insert containing a contact adapted to engage the contact in the other connector member;

a rotatable coupling ring on one of said shells adapted to couple with the other shell;

the interior of said coupling ring and the exterior of said other shell forming inner and outer concentric surfaces;

an annular groove formed in each of said surfaces, said grooves being axially aligned when said connector members are fully mated by said coupling ring;

radially deformable annular spring means lying in both of said grooves when said connector members are fully mated;

the groove in one of said concentric surfaces providing a front annular surface forming a high-angle rearwardly facing ramp;

a low-angle forwardly facing ramp formed on said one surface in front of the groove therein; and upon rotation of said coupling ring in one direction to mate said connector members said spring means riding over said low-angle ramp and snapping into said groove in said one surface to releasably lock said coupling ring to said other shell, and upon rotation of said coupling ring with a high torque in the opposite direction said spring means riding over said high-angle ramp to become released from said groove in said surface to allow unmating of said connector members.

2. An electrical connector as set forth in claim 1 wherein:

said coupling ring and said other shell embody matching screw threads; and said grooves are located at one end of said screw threads.

3. An electrical connector as set forth in claim 2 wherein:

said grooves are located behind the screw threads on said coupling ring and in front of said screw threads on said other shell, respectively; and said ramps are formed on the exterior of said other shell.

4. An electrical connector as set forth in claim 2 wherein:

said grooves are located in front of the screw threads on said coupling ring and behind said screw threads on said other shell.

5. An electrical connector as set forth in claim 4 wherein:

said ramps are formed on the exterior of said other shell.

6. An electrical connector as set forth in claim 4 wherein:

said ramps are formed on the interior of said coupling ring.

7. An electrical connector as set forth in claim 1 wherein:

said annular spring means comprises a ring having at least two radially extending projections thereon.

8. An electrical connector as set forth in claim 7 wherein:

said projections are bent portions of said ring.

9. An electrical connector as set forth in claim 3 wherein:

said annular spring means comprises a ring having at least two radially inwardly extending bent portions lying in the groove in said other shell.

10. An electrical connector as set forth in claim 6 wherein:

said annular spring means comprises a ring having at least two radially outwardly extending bent portions lying in the groove in said coupling ring.

11. An electrical connector as set forth in claim 2 including:

a first annular sealing member between one end of said coupling ring and said one shell; and a second annular sealing member between the other end of said coupling ring and said other shell, said screw threads and said spring means being located between said sealing members when said connector members are fully mated.

12. An electrical connector comprising: first and second mating connector members;

each said connector member comprising a shell surrounding an insert containing a contact adapted to engage the contact in the other connector member;

a rotatable ring on one of said shells having first coupling means thereon adapted to interengage with second coupling means on the other shell;

an annular groove formed in the interior of said ring behind said first coupling means;

an annular groove formed in the exterior of said other shell in front of said second coupling means, said grooves being axially aligned when said connector members are fully mated by said coupling ring;

radially deformable annular spring means carried by said ring and lying in both of said grooves when said connector members are fully mated;

the groove in said other shell providing a front annular surface forming a high-angle rearwardly facing ramp;

a low-angle forwardly facing ramp formed on the exterior of said other shell in front of the groove therein; and upon rotation of said ring in one direction to mate said connector members said spring means riding up over said low-angle ramp and snapping inwardly into said groove in said other shell to releasably lock said ring to said other shell, and upon rotation of said ring with a high torque in the opposite direction said spring means riding up over said high-angle ramp to become released from said groove in said other shell to allow unmating of said connector members.

13. An electrical connector as set forth in claim 12 wherein:

said annular spring means comprises a ring having at least two radially inwardly extending bent portions lying in said groove in said other shell.

14. An electrical connector as set forth in claim 12 including:

a first annular sealing member between said ring and said one shell behind said groove in said ring; and a second annular sealing member between said ring and said other shell behind said second coupling means.

15. An electrical connector comprising:

first and second mating connector members;

each said connector member comprising a shell surrounding an insert containing a contact adapted to engage the contact in the other connector member;

a rotatable ring on one of said shells having first coupling means thereon adapted to interengage with second coupling means on the other shell;

an annular groove formed in the interior of said ring in front of said first coupling means;

an annular groove formed in the exterior of said other shell behind said second coupling means, said grooves being axially aligned when said connector members are fully mated by said coupling ring;

radially deformable annular spring means carried by said ring and lying in both of said grooves when said connector members are fully mated;

the groove in said other shell providing a front annular surface forming a high-angle rearwardly facing ramp;

a low-angle forwardly facing ramp formed on the exterior of said other shell in front of the groove therein; and upon rotation of said ring in one direction to mate said connector members said spring means riding up over said low-angle ramp and snapping inwardly into said groove in said other shell to releasably lock said ring to said other shell, and upon rotation of said ring with a high torque in the opposite direction said spring means riding up over said high-angle ramp to become released from said groove in said other shell to allow unmating of said connector members.

16. An electrical connector comprising:

first and second mating connector members;

each said connector member comprising a shell surrounding an insert containing a contact adapted to engage the contact in the other connector member;

a rotatable ring on one of said shells having first coupling means thereon adapted to interengage with second coupling means on the other shell;

an annular groove formed in the interior of said ring in front of said first coupling means;

an annular groove formed in the exterior of said other shell behind said second coupling means, said grooves being axially aligned when said connector members are fully mated by said coupling ring;

radially deformable annular spring means carried by said other shell and lying in both of said grooves when said connector members are fully mated;

the groove in said ring providing a front annular surface forming a high-angle rearwardly facing ramp;

a low-angle forwardly facing ramp formed on the interior of said ring in front of the groove therein; and upon rotation of said ring in one direction to mate said connector members said spring means riding over said low-angle ramp and snapping outwardly into said groove in said ring to releasably lock said ring to said other shell, and upon rotation of said ring with a high torque in the opposite direction said spring means riding up over said high-angle ramp to become released from said groove in said ring to allow unmating of said connector members.

17. An electrical connector as set forth in claim 16 wherein:

said annular spring means comprises a split ring having at least two radially outwardly extending bent portions lying in said groove in said ring.

18. An electrical connector comprising:

first and second mating connector members;

each said connector member comprising a shell surrounding an insert containing a contact adapted to engage a contact in the other connector member;

a rotatable ring on one of said shells having first coupling means thereon, second coupling means on the other shell interengageable with said first coupling means;

an annular groove formed in the interior of said ring behind said first coupling means;

locking recess means on the exterior of said other shell in front of said second coupling means, said groove and said locking recess means being axially aligned when said connector members are fully mated by said coupling ring;

radially deformable annular spring means carried by said ring and lying in said groove, said spring means engaging said locking recess means when said connector members are fully mated;

a forwardly facing ramp formed on the exterior of said other shell in front of said locking recess means; and upon rotation of said ring in one direction to mate said connector members said spring means riding up over said ramp and snapping inwardly into said locking recess means to releasably lock said ring to said other shell, and upon rotation of said ring in the opposite direction said spring means riding out of said locking recess means to allow unmating of said connector members.

19. An electrical connector as set forth in claim 18 wherein:

said annular spring means comprises a ring having at least two radially inwardly extending bent portions.

20. An electrical connector as set forth in claim 18 including:

a first annular sealing member between said ring and said one shell behind said groove in said ring; and a second annular sealing member between said ring and said other shell behind said second coupling means.

* * * * *